United States Patent [19]

Dahlman

[11] 3,994,149

[45] Nov. 30, 1976

[54] PRESS FOR HYDROSTATIC EXTRUSION OF TUBES

[75] Inventor: Göran Dahlman, Helsingborg, Sweden

[73] Assignee: Allmanna Svenska Elektriska Aktiebolaget, Vasteras, Sweden

[22] Filed: May 22, 1975

[21] Appl. No.: 580,466

[30] Foreign Application Priority Data

June 7, 1974 Sweden ..... 7407509

[52] U.S. Cl. ..... 72/60; 72/264

[51] Int. Cl.[2] ..... B21C 25/04

[58] Field of Search ..... 72/60, 264–266, 72/370, 476

[56] References Cited

UNITED STATES PATENTS

| | | | |
|---|---|---|---|
| 2,063,563 | 12/1936 | Sparks | 72/265 |
| 2,809,750 | 10/1957 | Arenz | 72/264 |
| 3,178,920 | 4/1965 | Buffet | 72/264 X |
| 3,475,942 | 11/1969 | Murphy et al. | 72/265 |
| 3,541,831 | 11/1970 | Simonton | 72/266 |
| 3,751,958 | 8/1973 | Nilsson | 72/60 |
| 3,826,122 | 7/1974 | Braeuninger | 72/264 |

*Primary Examiner*—Milton S. Mehr

*Attorney, Agent, or Firm*—Watson, Cole, Grindle & Watson

[57] ABSTRACT

A press for hydrostatic extrusion of tubes includes a die having a die opening therein and a mandrel projecting into the die opening and forming therewith a gap for shaping the tubular billet into a tube. The mandrel includes a carrier with a bore therein and a tip inserted in and filling the bore of the carrier. The tip includes an outer sleeve of hard metal and a core filling the sleeve formed of a material which has approximately the same E-modulus of the material of the carrier, such as steel. The inner end of the sleeve is enlarged and the front part of the carrier is compressed around the tip to fix the tip axially in the carrier.

5 Claims, 1 Drawing Figure

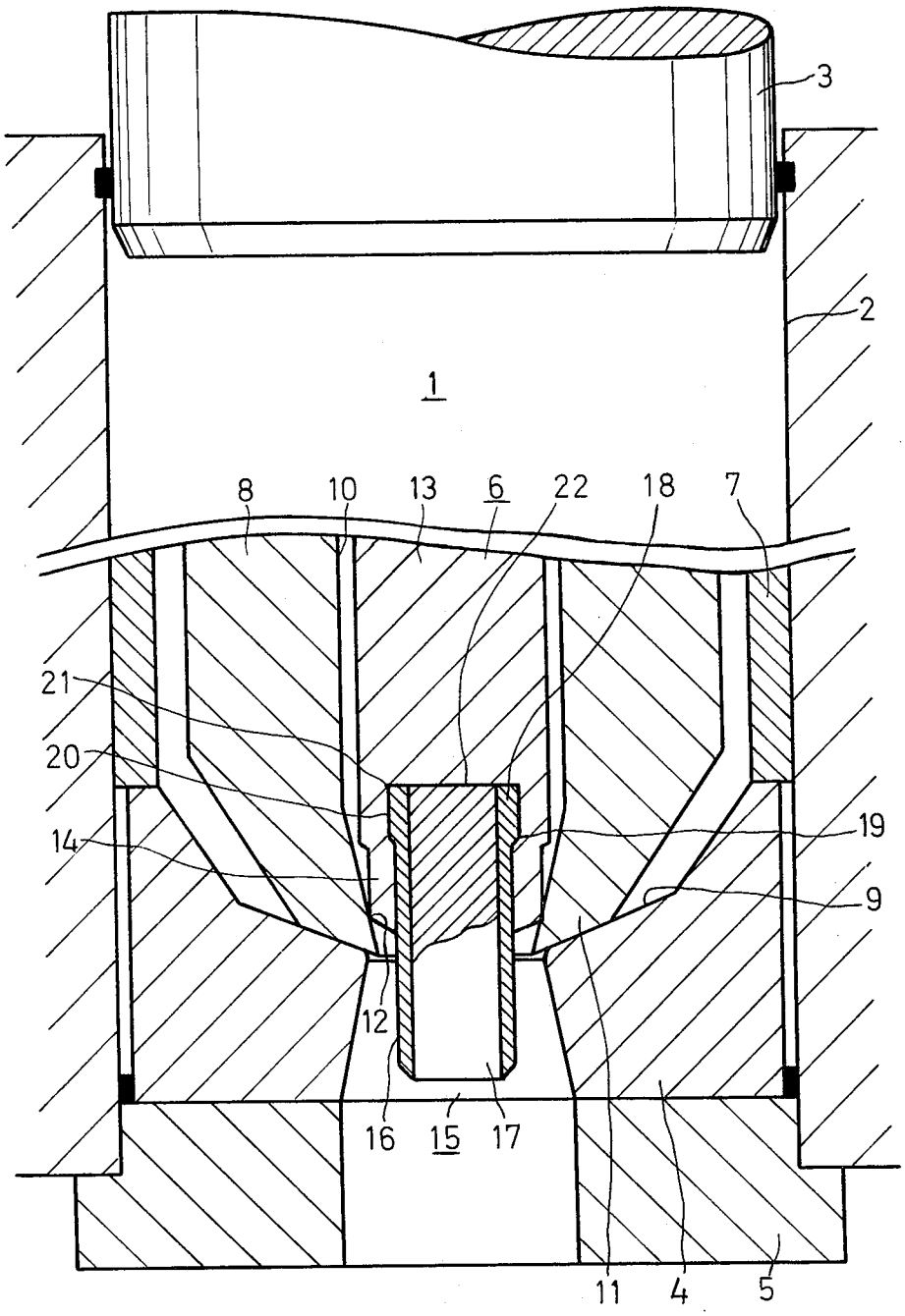
3
2
1
8
10
13
6
22
18
7
21
20
14
19
9
12
16
15
17
11
4
5

PRESS FOR HYDROSTATIC EXTRUSION OF TUBES

BACKGROUND OF THE INVENTION

1. Field of the Invention

The present invention relates to a press for hydrostatic extrusion of tubes. The press contains a pressure chamber which is composed of a high pressure cylinder, a pressure-generating punch insertable into one end of the cylinder and a die inserted into the other end of the cylinder. In the pressure chamber there is arranged a mandrel which is held axially fixed in relation to the die by support members. The tip of the mandrel projects into an opening in the die so that an annular gap is formed, in which a tubular billet is shaped into a tube with dimensions determined by the dimensions of the gap when the billet is subjected to a high all-sided hydrostatic pressure in a surrounding pressure medium. A press of this kind and its mode of operation is disclosed in greater detail in U.S. Pat. No. 3,751,958.

The Prior Art

2. Particularly when extruding a heated billet the mandrel is subjected to very great stresses and the wear on the mandrel tip has caused considerable problems. It has been found to be technically difficult and expensive to make a whole mandrel of such materials as withstand both heat shocks and have such wear resistance that the mandrel has a sufficient life. The mandrel is therefore made in parts with a carrier of one material and a tip of a durable, heat-resistant material. The attachment of a mandrel tip of a material with a high E modulus in a mandrel carrier of a material with a lower E-modulus, for example attaching a mandrel tip of hard metal or silicon nitride into a carrier of steel, has involved problems which are difficult to solve. When attaching a tip into a bore in the mandrel carrier, this has broken at the interior part of the bore because of the fact that different compressions of the material give rise to stress concentrations.

SUMMARY OF THE INVENTION

The press according to the invention is characterised in that the mandrel contains a carrier with a bore and a tip attached to this bore. The tip consists of a sleeve of a wear-resistant, heat-resistant material and a core of another material with the same or approximately the same E-modulus as the material of the carrier. The tip projects in the opening in the die and forms together with the die a gap which determines the radial dimensions of an extruded tube. The sleeve can be made of hard metal or silicon nitride and the mandrel carrier and the core of the sleeve of steel which has considerably lower E-modulus than hard metal and silicon nitride. The mandrel tip can be soldered or attached in the mandrel carrier by pressing, or be attached both by pressing and soldering. To achieve a good axial fixation of the mandrel tip when the tip is only pressed into the carrier, the inner part of the tip is made with a larger diameter than the outer part and the outermost part of the mandrel carrier is pressed around the mandrel tip. The difference in diameter results in the formation of a shoulder on the mandrel tip so that a safe axial fixation is obtained in said pressing operation.

BRIEF DESCRIPTION OF THE DRAWING

The invention is described more closely with reference to the accompanying drawing which shows in cross-section the die end of a press embodying the invention.

In this drawing, FIG. 1 designates a pressure chamber which comprises a high pressure cylinder 2, a pressure generating punch 3 and a die 4 resting on a die support 5. The rest of the press is not shown. In the pressure chamber there is a mandrel 6 which is attached by its inner part (not shown) to a plate which rests on a support tube 7 which, in turn, rests on the die in the pressure chamber. The mandrel is thus fixed axially in relation to the die during the extrusion. In the pressure chamber is a tubular billet 8. The units are shown in a position immediately prior to the beginning of the extrusion. The billet 8 is pressed against the conical surface 9 of the die with such a great force that the tip is upset so that the diameter of the hole 10 is reduced at the mandrel tip 11 to such an extent that a sealing contact is obtained with the edge 12 of the front part 14 of the mandrel carrier 13. The mandrel tip 15 consists of a sleeve 16 of a durable, heat-resistant material, for example hard metal, and a core 17 which fills up the sleeve completely. The inner part 18 of the sleeve has greater diameter than the outer one, thus forming a shoulder 19. The outer part of the mandrel carrier is pressed together around the mandrel tip so that the shoulder 19 provides a good axial fixation of the mandrel tip. The pressing of the mandrel tip can be combined with a soldering of the mandrel tip in the bore. In hydrostatic extrusion, operation is carried out at such high pressure levels, usually between 10 and 20 Kbar, that a noticeable compression of the material of the mandrel is obtained. The change in dimensions in case of a three-dimensional state of strain is of the order of magnitude of 0.2 % for steel and 0.1 % for hard metals for a pressure change of 10 kbar. If a solid mandrel tip is used in the bore 20 in the mandrel carrier 13, the difference in compressibility of the material in the carrier and the tip means that the difference in dimensional change gives rise to great stress concentrations at the corner 21 of the bottom 22 of the bore 20. By making the mandrel tip 15 in the form of a sleeve 16 of hard metal which is filled with a core 17 of the same material as the mandrel carrier 13, i.e. of a material with the same E-modulus, the difference in the dimensional change because of the compressibility of the mandrel carrier and the mandrel tip, and thus the stresses caused by these difference, is reduced.

I claim:

1. Press for hydrostatic extrusion of tubes, comprising a pressure chamber, containing a high pressure cylinder, a pressure generating punch insertable into the cylinder, a die arranged in the cylinder and a mandrel axially fixed in relation to said die, said mandrel projecting into the die opening and forming, together with the die, a gap in which a tubular billet is shaped into a tube when the billet is subjected to an all-sided hydrostatic pressure in a surrounding pressure medium, the mandrel (6) comprising a carrier (13) with a bore (20) therein, a tip (15) comprising a sleeve (16) of one material and a solid core (17), which completely fills up the sleeve (18), of another material having at least approximately the same E-modulus as the material of the carrier, the tip (15) completely filling the bore (20) in the carrier (13) and being axially fixed therein, the sleeve extending outwardly from the lower end of the carrier.

2. Press according to claim 1, in which the sleeve (16) of the tip (15) is made of hard metal and the core (17) and the mandrel carrier (13) of steel.

3. Press according to claim 1, in which the sleeve (16) of the tip (15) is made of silicon nitride and the core (17) and the mandrel carrier (13) of steel.

4. Press according to claim 1, in which the mandrel tip (15) is soldered into the mandrel carrier (13).

5. Press according to claim 1, in which the part (18) of the mandrel tip (15) projecting farthest into the bore (20) has a larger diameter than the rest of the mandrel tip (15), and the front part (14) of the mandrel carrier (13) is compressed around the mandrel tip (15), thus fixing the mandrel tip axially in the mandrel carrier (13).

* * * * *